US006446567B2

(12) United States Patent
Hindsley

(10) Patent No.: US 6,446,567 B2
(45) Date of Patent: Sep. 10, 2002

(54) PORTABLE HAND-OPERATED MACHINE QUILTING CLAMP

(76) Inventor: Lora L. Hindsley, 1336 Swallow Dr., Raleigh, NC (US) 27606

( * ) Notice: Subject to any disclaimer, the term of this patent is extended or adjusted under 35 U.S.C. 154(b) by 0 days.

(21) Appl. No.: 09/844,455

(22) Filed: Apr. 27, 2001

Related U.S. Application Data

(63) Continuation-in-part of application No. 09/499,775, filed on Feb. 8, 2000, now Pat. No. 6,223,665.

(51) Int. Cl.[7] ..... D05B 11/00; D05D 39/00; D06C 3/00; A44B 21/00

(52) U.S. Cl. ..... 112/117; 38/102.91; 24/510; 24/556

(58) Field of Search ..... 112/117, 118, 112/119, 311; 24/67.3, 67.5, 67.9, 507, 545, 556, DIG. 22, 557, 508, 509, 510; 38/102.91

(56) References Cited

U.S. PATENT DOCUMENTS

| | | | | |
|---|---|---|---|---|
| 522,991 | A | | 7/1894 | Laubin |
| 1,329,411 | A | | 2/1920 | Kanta et al. |
| 1,675,609 | A | | 7/1928 | Kelley |
| 1,937,491 | A | | 11/1933 | May |
| 2,279,628 | A | | 4/1942 | Marsack |
| 3,044,426 | A | | 7/1962 | Schwarzberger |
| 4,141,119 | A | * | 2/1979 | Nodo |
| 4,702,184 | A | | 10/1987 | Datlof |
| 5,072,866 | A | * | 12/1991 | Kolton et al. |
| 5,082,153 | A | | 1/1992 | Duester et al. |
| 5,103,747 | A | | 4/1992 | Resta et al. |
| 5,361,948 | A | | 11/1994 | Batts |
| 5,402,558 | A | | 4/1995 | Santapa |
| 5,549,127 | A | * | 8/1996 | Chang et al. ..... 24/510 X |
| 5,711,236 | A | | 1/1998 | Badger |
| 5,803,096 | A | * | 9/1998 | Lee ..... 24/556 X |
| 6,223,665 | B1 | * | 5/2001 | Hindsley ..... 112/117 |

* cited by examiner

*Primary Examiner*—Ismael Izaguirre
(74) *Attorney, Agent, or Firm*—Coats & Bennett, P.L.L.C.

(57) ABSTRACT

A portable, hand-operated quilting clamp capable of holding multiple layers of quilting material firmly together while being easily grasped by the user. A manually openable clamp body comprises top and bottom portions hingedly connected together and moveable between a clamping position and an open position and defining a fabric receiving gap. At least one spring is connected to the clamp body and biases the clamp closed. The clamp top portion has a handle extending away therefrom to aid in both opening the quilting clamp and gripping the quilting clamp by the user. With the clamp bottom portion supported from underneath, pressing on the handle urges the clamp top portion towards the open position. A cushion material, such as felt, is disposed on all or part of the bottom side of the bottom portion. The quilting clamp is ≧2 inches wide, but not more than about 4 inches.

17 Claims, 2 Drawing Sheets

PORTABLE HAND-OPERATED MACHINE QUILTING CLAMP

This is a continuation-in-part of U.S. patent application Ser. No. 09/499,775, filed Feb. 8, 2000 is now 6,223,665 which is incorporated herein by reference.

BACKGROUND OF THE INVENTION

The present invention relates to sewing accessories, and more particularly to a quilting clamp that securely holds multiple layers of material for machine quilting and allows for easy manipulation thereof.

Machine quilting typically requires the user to hold multiple layers of quilting materials, such as fabric and batting, firmly together while stitching the desired quilt pattern. Holding the multiple layers of quilting materials together while machine quilting may be difficult in some circumstances, such as when the user has only an inch or so of quilting material to grasp, or when the user suffers from hand or wrist disabilities such as arthritis or carpal tunnel syndrome.

While numerous large-scale quilting apparatuses have been proposed for machine quilting use in manufacturing environments (e.g., in a factory), there has been a long felt need for portable machine quilting aids that can be easily used by individual quilters, such as in a residential setting. In particular, there has been a long felt need for a portable hand-operated quilting clamp capable of holding multiple layers of quilting material firmly together, thereby freeing the quilter to concentrate on other quilting tasks, such as forming the stitching pattern. Further, because it can be difficult to manipulate the multiple quilting material layers in the desired pattern when there is only an edge to grasp, there has been a need for a quilting clamp that can be easily grasped by the quilter so as to allow the user to easily move the multiple layers of quilt material in the desired quilt pattern.

BRIEF SUMMARY OF THE INVENTION

The present invention provides a portable, hand-operated quilting clamp capable of holding multiple layers of quilting material firmly together while being easily grasped by the user so as to allow easily directed movement of the combined layers of quilt material in the desired quilt pattern.

A manually openable clamp body comprises top and bottom portions hingedly connected together and moveable between a clamping position and an open position. At least one spring is connected to the clamp body and biases the clamp top portion towards the clamp bottom portion so that the quilting clamp is operable to grip fabric when in the clamping position. A fabric receiving gap is defined between the top and bottom portions in the open position. The clamp top portion has a handle extending away therefrom to aid in both opening the quilting clamp and gripping the quilting clamp by the user. With the clamp bottom portion supported from underneath, pressing on the handle urges the clamp top portion towards the open position.

The quilting clamp may advantageously include cushion material, such as felt, on all or part of the bottom side of the bottom portion so as to help reduce the risk of scratching any worksurfaces while preserving easy of movement. In addition, the quilting clamp main body may have a width of at least two inches, but advantageously not more than about four inches.

DETAILED DESCRIPTION OF THE INVENTION

Figure 1:
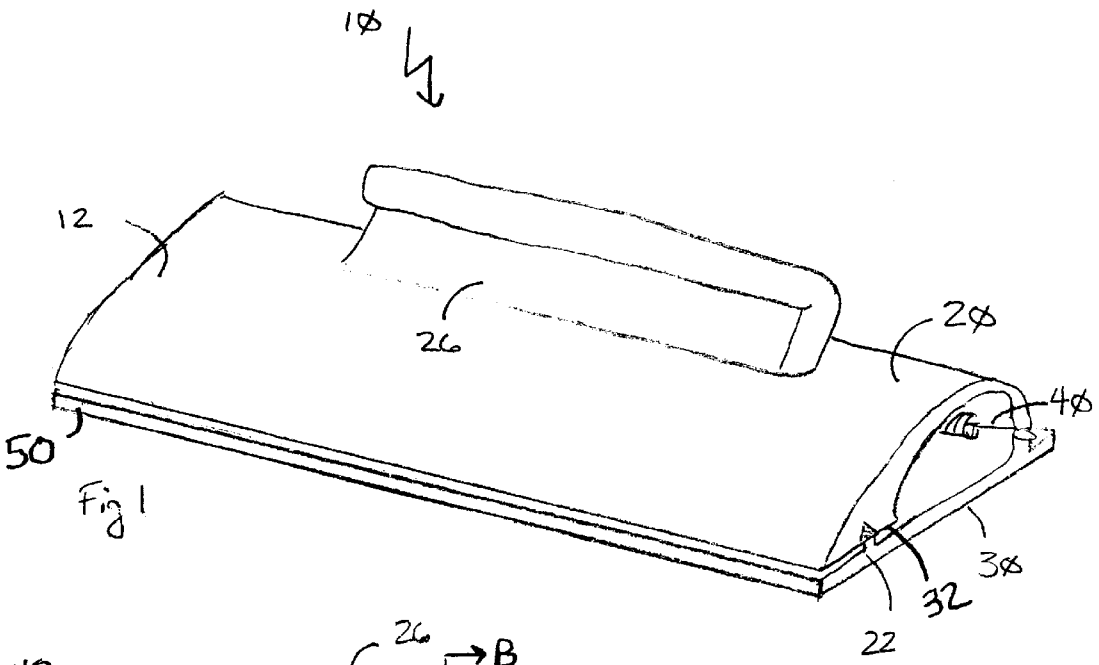
FIG. 1 shows a perspective view of one embodiment of a quilting clamp according to the present invention in the closed (or clamping) position.
Figure 2:
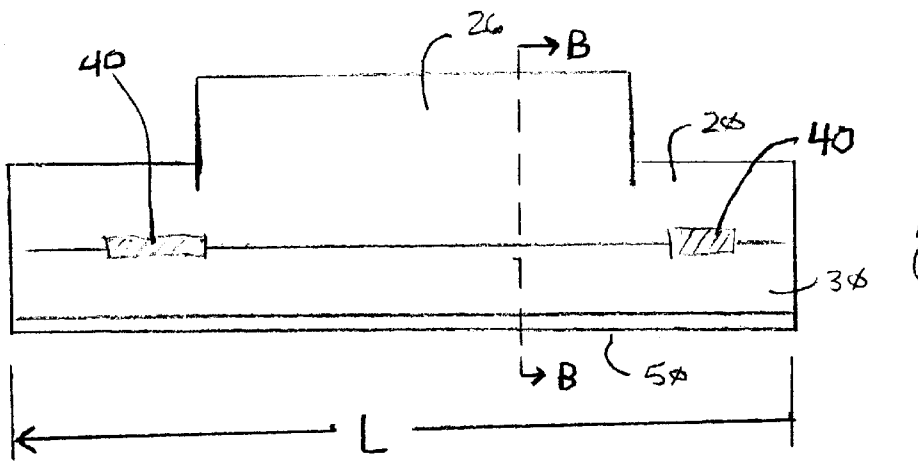
FIG. 2 shows a back view of the embodiment of FIG. 1.
Figure 3:
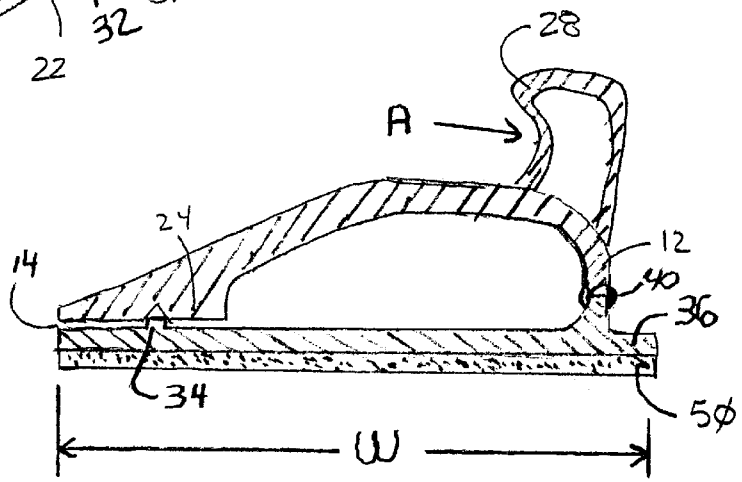
FIG. 3 shows a section view of the embodiment of FIG. 2 along line B—B.

One embodiment of the quilting clamp of present invention is shown in FIGS. 1–3, and generally indicated at 10. The quilting clamp 10 is a manually operated, easily portable aid for quilting. The quilting clamp 10 is easily opened, via the handle 26, to allow insertion of one or more layers of quilting materials. When pressure on the handle 26 is released, the quilting clamp 10 closes, so as to firmly grip the quilting materials between respective clamp faces 22,32. In use, the user grips the quilting clamp 10 by the handle 26 and moves the combined quilting clamp 10 and quilt materials as a single unit. Thus, the quilting materials may be easily held in the proper relative orientations while retaining ease of combined movement so as to facilitate the introduction of the desired quilt stitching pattern.

Figure 4:
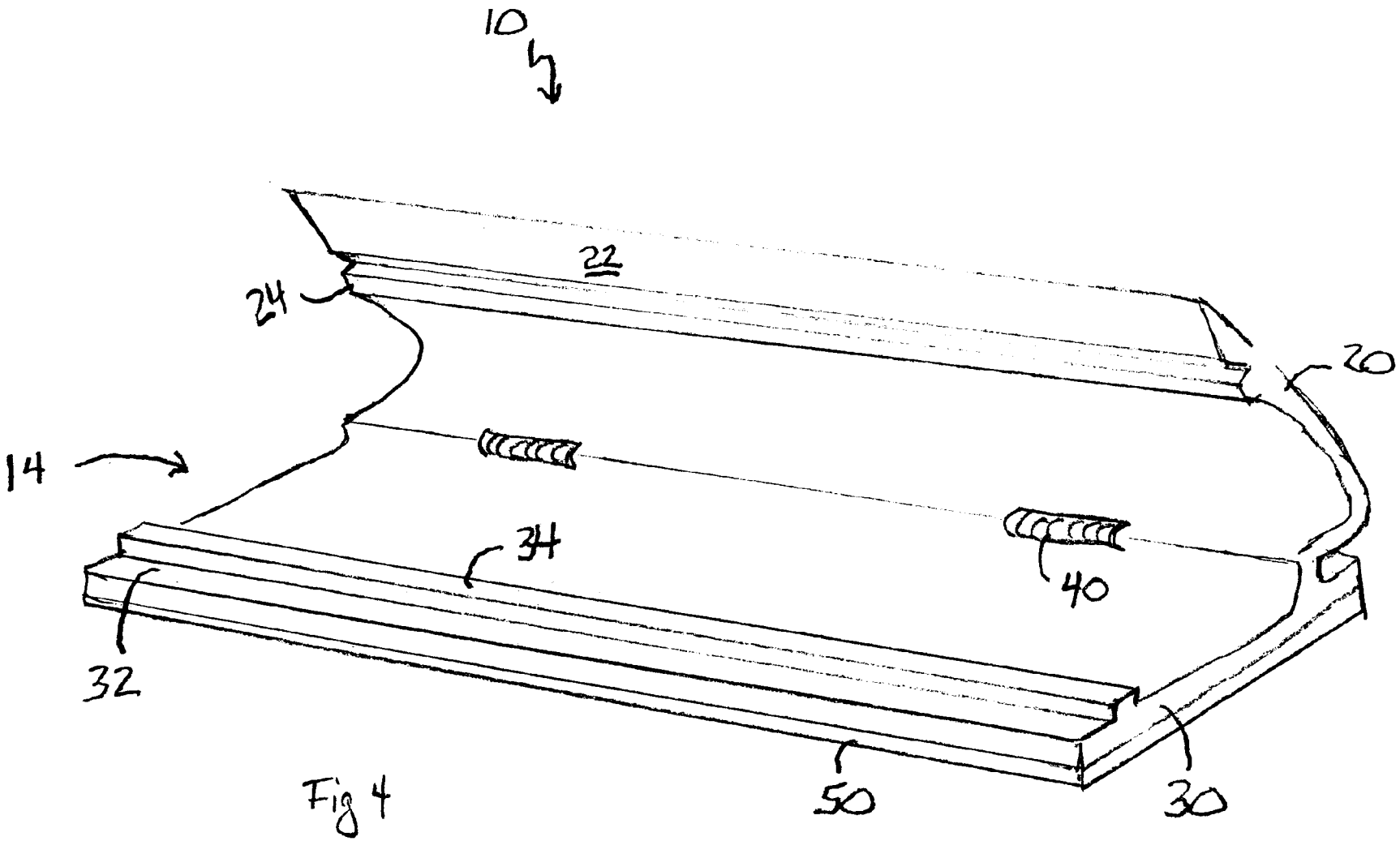
FIG. 4 shows a perspective view of the embodiment of FIG. 1 in the open position.

The quilting clamp 10 includes a main body 12 comprising a top portion 20 hingeably connected to a bottom portion 30. While the bottom portion 30 is preferably relatively flat, as shown in FIG. 3, the top portion 20 is preferably generally arched, also as shown in FIG. 3, so as to provide substantial interior spacing between the top and bottom portions 20,30 for a portion of the interior of the main body 12. When the quilting clamp 10 is open, the top portion 20 and the bottom portion 30 together help define a fabric receiving gap 14 that communicates with the interior space described above. This fabric receiving gap 14 is larger when the quilting clamp 10 is open (see FIG. 4) and smaller—or completely closed—when the quilting clamp 10 is closed ("clamping position") (see FIG. 1). The top and bottom portions 20,30 are urged together by one or more springs 40, typically disposed near the ends of the top and bottom portions 20,30 opposite the grip faces 22,32. The grip faces 22,32 of the top and bottom portions 20,30 may include appropriate gripping ridges (e.g., ribs or a plurality of teeth) 24,34 for aiding in the gripping of the quilting materials, as desired. In addition, the bottom side of the bottom portion 30 may have a suitable cushion material 50, such as felt, attached thereto. The cushion material 50 may cover substantially all, or only a portion, of the bottom side of the bottom portion 30.

A handle 26 is attached to, or integrally formed with, the top portion 20. This handle 26 extend outwardly from the top portion 20 and provides a convenient gripping location for a user. The handle 26 should extend outward from the top portion 20 generally normal (90°±30°) thereto. The handle 26 may extend the length of the main body 12, but may also extend along only a portion thereof as shown in the Figures. While the handle 26 may take a variety of forms, such as that of a simple flange or knob, the distal portion of the handle 26 may advantageously include a curved portion 28 to aid in manual gripping.

The quilting clamp 10 is normally in the closed position, where the distal portions of the top and bottom portions 20,30 (i.e., the grip faces 22,32) are very closely spaced, or touching. The quilting clamp 10 is opened by supporting the quilting clamp 10 from underneath (e.g., placing the quilting clamp 10 on a worksurface or on the palm of the user's hand), and pressing on the handle 26 in the direction indicated by arrow A. The rotational force imparted via the handle 26 overcomes the biasing force of the spring(s) 40, thereby allowing the grip faces 22,32 of the top and bottom portions 20,30 to move apart. To help balance the rotational force applied at the handle 26, the bottom portion 30 may optionally include a short rearward flange 36. With the quilting clamp 10 held open, the quilting materials are inserted into the fabric receiving gap 14 and the pressure on the handle 26 released. The biasing force of the spring(s) 40 urges the distal portions of the top and bottom portions 20,30 back together, gripping the quilting materials therebetween. With the preferred generally arched top portion 20, there should be ample space within the interior of the main body 12 of the quilting clamp 10 to hold the fabric when clamped, even if the fabric is folded over or otherwise rather bulky. The user may then grip the handle 26 in one hand and move the quilting material around as desired by simply moving the quilting clamp 10. In addition, the quilting clamp 10 may be easily moved to another position relative to the quilting materials (e.g., moved farther down an edge), by simply pressing on the handle 26 and sliding the quilting clamp 10 along the quilting material.

The main body 12 of the quilting clamp 10, including both the top portion 20 and the bottom portion 30, are preferably made from suitable plastic material, such as polypropylene or the like, using any known manufacturing technique, such as injection molding and/or blow-molding. The springs 40 may be metal (e.g., common coil springs), or plastic, or any other suitable material. The hinge between the top portion 20 and the bottom portion 30 may advantageously be an integral living hinge or may be formed by the spring(s) 40. Other hinge arrangements may also be used.

So that the quilting clamp 10 may grip sufficient material, the quilting clamp 10 should have an overall width W of at least two inches. However, so that the quilting clamp 10 remains lightweight and easy to use considering the often cramped quarters around a residential sewing machine, the quilting clamp 10 may advantageously have a width no larger than about four inches. It has been found that a length L for the quilting clamp 10 of between about five and about ten inches, and more preferably eight and one-half inches, is suitable.

The present invention may be carried out in other specific ways than those herein set forth without departing from the scope of the invention. The present embodiments are, therefore, to be considered in all respects as illustrative and not restrictive, and all changes coming within the meaning and equivalency range of the appended claims are intended to be embraced therein.

What is claimed is:

1. A portable, hand-operated quilting clamp, comprising:

a manually openable clamp body comprising top and bottom portions hingeably connected and moveable between a clamping position and an open position, said top and bottom portions defining a fabric receiving gap in said open position and operable to grip fabric in said clamping position;

distal ends of said top and bottom portions substantially aligned so as to oppose one another in said clamping position;

at least one spring connected to said clamp body and biasing said clamp top portion towards said clamp bottom portion;

a handle attached to said clamp top portion and extending away therefrom in a generally normal direction, wherein, with said clamp bottom portion supported from underneath, pressing on said handle urges said clamp top portion towards said open position; and said clamp body having a width of at least two inches.

2. The quilting clamp of claim 1 wherein said clamp body has a width of not more than about four inches.

3. The quilting clamp of claim 1 wherein said handle comprises a curved finger grip portion.

4. The quilting clamp of claim 1 wherein said clamp top portion has an arched cross-section.

5. The quilting clamp of claim 1 wherein said top and bottom portions hingeably connect via said at least one spring.

6. The quilting clamp of claim 1 wherein at least one of said top and bottom portions have gripping ridges on an interior surface thereof.

7. The quilting clamp of claim 1 wherein said handle is integrally formed with said top portion.

8. A portable, hand-operated quilting clamp, comprising:

a manually openable clamp body comprising top and bottom portions hingeably connected and moveable between a clamping position and an open position, said top and bottom portions defining a fabric receiving gap in said open position and operable to grip fabric in said clamping position;

at least one spring connected to said clamp body and biasing said clamp top portion towards said clamp bottom portion;

a handle attached to said clamp top portion and extending away therefrom in a generally normal direction, wherein, with said clamp bottom portion supported from underneath, pressing on said handle urges said clamp top portion towards said open position;

said clamp body having a width of at least two inches; and a cushion material disposed over at least a portion of said clamp bottom portion away from said clamp top portion.

9. The quilting clamp of claim 8 wherein said clamp bottom portion includes an inner surface disposed proximate said clamp top portion and a outer surface disposed away from said clamp top portion, and wherein said cushion material substantially covers said outer surface of said clamp bottom portion.

10. A portable, hand-operated quilting clamp, comprising:

a manually openable clamp body comprising top and bottom portions hingeably connected and moveable between a clamping position and an open position, said top and bottom portions defining a fabric receiving gap is said open position and operable to grip fabric in said clamping position;

at least one spring connected to said clamp body and biasing said clamp top portion towards said clamp bottom portion;

a handle attached to said clamp top portion and extending away therefrom in a generally normal direction, wherein, with said clamp bottom portion supported from underneath, pressing on said handle urges said clamp top portion towards said open position;

said clamp body having a width of at least two inches; and a second spring connected to said clamp body and biasing said clamp body towards said clamping position.

11. The quilting clamp of claim 2 wherein said cushion material substantially covers said clamp bottom portion on a side thereof away from said clamp top portion, and wherein:

said handle is integrally formed with said top portion;

said clamp top portion has an arched cross-section;

said top and bottom portions hingeably connect via said at least one of spring;

at least one of said top and bottom portions have gripping ridges on an interior surface thereof; and said clamp body has a width of not more than about four inches.

12. The quilting clamp of claim 11 further comprising a second spring connected to said clamp body and biasing said clamp body towards said clamping position and wherein said top and bottom portions hingedly connect via at least one of said springs.

13. A portable, hand-operated quilting clamp, comprising:

a manually openable clamp body comprising top and bottom portions hingeably connected and moveable between a clamping position and an open position, said clamp top portion having a generally arched cross-section, said top and bottom portions defining a fabric receiving gap in said open position and operable to grip fabric in said clamping position;

at least one of said top and bottom portions have gripping ridges on an interior surface thereof; and at least one spring hingeably connecting said top and bottom portions and biasing said clamp top portion towards said clamp bottom portion;

a handle attached to said clamp top portion and extending away therefrom in a generally normal direction, said handle having a curved finger grip portion, wherein, with said clamp bottom portion supported from underneath, pressing on said handle urges said clamp top portion towards said open position;

a cushion material disposed over at least a portion of said clamp bottom portion on a side thereof away from said clamp top portion; and said clamp body having a width of at least two inches and not more than about four inches.

14. The quilting clamp of claim 13 further including a second spring connected to said clamp body and biasing said clamp body towards said clamping position.

15. The quilting clamp of claim 13 wherein said handle is integrally formed with said top portion.

16. The quilting clamp of claim 13 wherein said clamp body has a length of between about five inches and about ten inches.

17. The quilting clamp of claim 13 wherein said at least one spring is a coil spring.

* * * * *